United States Patent [19]

Kono et al.

[11] 4,355,959

[45] Oct. 26, 1982

[54] ROTATION SENSOR OF A SWASH-PLATE TYPE COMPRESSOR

[75] Inventors: Hiroya Kono; Jun Hasegawa, both of Kariya; Mitsukane Inagaki, Anjo; Hisao Kobayashi, Kariya, all of Japan

[73] Assignee: Kabushiki Kaisha Toyoda Jidoshokki Seisakusho, Aichi, Japan

[21] Appl. No.: 195,055

[22] Filed: Oct. 8, 1980

[30] Foreign Application Priority Data

Oct. 26, 1979 [JP] Japan ..... 54-138864
Aug. 26, 1980 [JP] Japan ..... 55-117572

[51] Int. Cl.[3] ..... F04B 49/00
[52] U.S. Cl. ..... 417/223
[58] Field of Search ..... 417/223, 316–319, 417/15; 60/403, 406, 435, 441; 91/361, 363 R, 363 A, 362

[56] References Cited

U.S. PATENT DOCUMENTS 4,017,217 4/1977 Lamers ..... 417/223

*Primary Examiner*—Carlton R. Croyle
*Assistant Examiner*—Edward Look
*Attorney, Agent, or Firm*—Browdy and Neimark

[57] ABSTRACT

A rotation sensor for sensing a swash-plate type compressor being in rotational state. An electromagnetic sensor including a permanent magnet and a coil disposed in the neighborhood thereof is fixed on a housing of the compressor such that it may be opposed to a part of a rotational locus described by a specific portion of the external periphery of the swash-plate. The electromagnetic sensor generates a signal pulse everytime the specific portion passes nearby. When the swash-plate is made of a non-magnetic material some magnetic body is fixed on the external periphery of the swash-plate for constituting a portion-to-be-sensed. This magnetic body may be a ring or lump of ferrous material, a temperature sensitive ferrite, a permanent magnet, etc.

14 Claims, 16 Drawing Figures

ROTATION SENSOR OF A SWASH-PLATE TYPE COMPRESSOR

BACKGROUND OF THE INVENTION

This invention relates to a swash-plate type compressor, and more particularly to a rotation sensor thereof.

When a compressor connected drivingly with a driving apparatus gets into a trouble by chance of non-rotational status due to seizure in a sliding place or like causes, it is liable to consequently damage the driving apparatus because of the over load applied thereto.

In a recent trend wherein a compressor for a vehicle air conditioning is so designed as to be placed under a common driving system or apparatus, by sharing the power from an engine for driving the car, with a water pump, an alternator, etc., through a single belt, a possible breakage of the belt due to the non-rotation of the compressor may give rise to overheating of the engine, which can lead to a serious car accident.

For preventing occurrence of such a trouble and accident, it is necessary to constantly watch the operation condition of the compressor so that the compressor may be separated or disconnected from the driving apparatus when the rotation of the compressor has come down to a conspicuously low speed or has been completely stopped. For this purpose a rotation sensor is an absolute necessity for compressors.

SUMMARY OF THE INVENTION

This invention was made from such a background. It is therefore a primary object of this invention to provide a rotation sensor for a swash-plate type compressor.

For achieving this object an electromagnetic sensor including a permanent magnet and a coil placed in the neighborhood of the former is effectively utilized. In this electromagnetic sensor an electric signal, which is respondent to the variation of the magnetic flux density taking place whenever a magnetic body passes by near the sensor, is generated. The electromagnetic sensor is disposed at a position faced to a part of a movement locus which is described by a part of the peripheral portion of a swash-plate according to the rotation of the swash-plate. This part of the peripheral portion of the swash-plate can be effectively utilized as a portion-to-be-sensed by the electromagnetic sensor.

When the swash-plate is wholly made of a magnetic material such as cast iron a part of the swash-plate, i.e. a part of the peripheral portion thereof can be utilized as the portion-to-be-sensed (hereinafter called sensed portion for short). When the swash-plate is however made of a non-magnetic material such as an aluminum alloy, a magnetic body is fixed on a suitable place or area of the peripheral portion thereof for playing a role of the sensed portion. As the peripheral portion of the swash-plate shows a large quantity of motion against the electromagnetic sensor, when the former repeats an approaching and departing motion to and from the latter owing to the rotation of the swash-plate, the resulting output signals from the electromagnetic sensor are very sharp or distinct.

Another object of this invention is to provide a rotation sensor of highest possible sensibility. In order to achieve this object a pair of parts of the peripheral portion of the swash-plate separated from each other with a phase difference of approximately 180° and describing a same locus are utilized as the sensed portions. Due to this way of determining the two parts as sensed portions two pulses of electric signal can be obtained from the electromagnetic sensor per one rotation of the swash-plate. Besides, this selecting way of the two parts enables sharp and high peaks of the pulses to be obtained, leading to easy and accurate sensing of the rotation of the swash-plate.

Further object of this invention is to provide a rotation sensor wherein the electromagnetic sensor can be easily attached to a compressor housing. For attaining this object the electromagnetic sensor is fixedly placed in a pair of recesses of semicircle shape in its section which are respectively formed at a joining place of the two cylinder blocks of plane symmetry, which constitute a principal portion of the compressor housing for the compressor by being joined face to face at the symmetrical planes thereof, that is to say, the sensor is located in the recess formed between the two symmetrical cylinder blocks in a sandwiched state.

When the compressor housing is made of a non-magnetic material such as aluminum, etc., the electromagnetic sensor may be fixed on the outside of the compressor housing at such a location as to be opposed, with the wall of the compressor housing inbetween, to the sensed portion. As there is no need of air-tight arrangement between the electromagnetic sensor and the compressor housing, in this instance, attachment of the former to the latter becomes very easy and convenient. It largely diminishes the risk of leakage of refrigerant from the compressor.

DETAILED DESCRIPTION OF THE PREFERRED EMBODIMENTS

Figure 1:
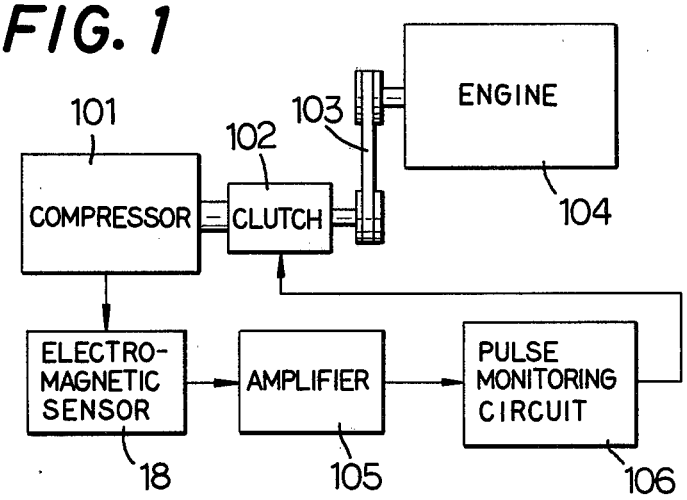
FIG. 1 is a schematic diagram of an air conditioning system for a vehicle including a compressor which is provided with a rotation sensor of this invention.

FIG. 1 shows a swash-plate type compressor used for vehicle air conditioning, wherein the swash-plate type compressor 101 is connected, via an electromagnetic clutch 102 and a belt transmission mechanism 103, to an internal combustion engine 104 for driving a car.

Figure 2:
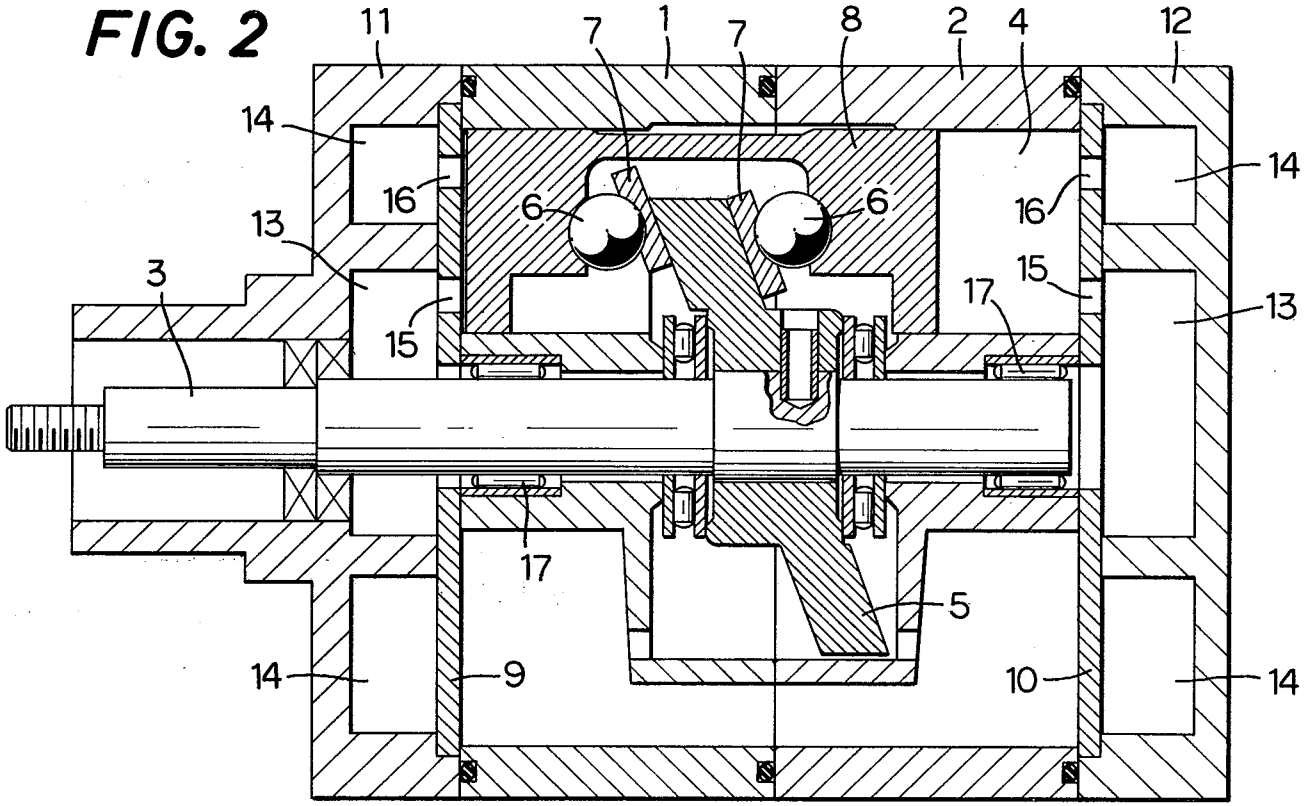
FIG. 2 is an axial sectional view of the compressor shown in FIG. 1.

The swash-plate type compressor 101 is shown in enlargement in FIG. 2 wherein a pair of cylinder blocks 1, 2 fixed to each other face to face. A rotary shaft 3 is pierced through, extending along the central portion of, the pair of cylinder blocks 1, 2 and is rotatably supported by a pair of radial bearings 17. A suitable number of cylinder bores 4 are bored in the cylinder blocks 1 and 2 parallel to the rotary shaft 3. On a swash-plate 5 which is secured on the rotary shaft 3 in a slant posture a plurality of pistons 8 are engaged by way of a pair of bearing devices respectively consisting of a ball 6 and a shoe 7. The piston 8 is slidably reciprocated in the cylinder bore 4 owing to the rotating power of the swash-plate 5.

Each outer side surface of the cylinder block 1, 2 is respectively fluid-tightly sealed with a front and rear housing 11, 12 via a valve plate 9, 10 sandwiched inbetween. Either of the front and rear housing 11, 12 is provided with a suction chamber 13 and discharge chamber 14 respectively, which are not only communicated with an external refrigerating circuit but also with the respective nearby cylinder bore 4, 4 through a suction valve port 15 and a discharge valve port 16 formed in the valve plate 9, 10. The suction valve port 15 and the discharge valve port 16 are respectively provided with a reed valve (although not shown).

Figure 3:
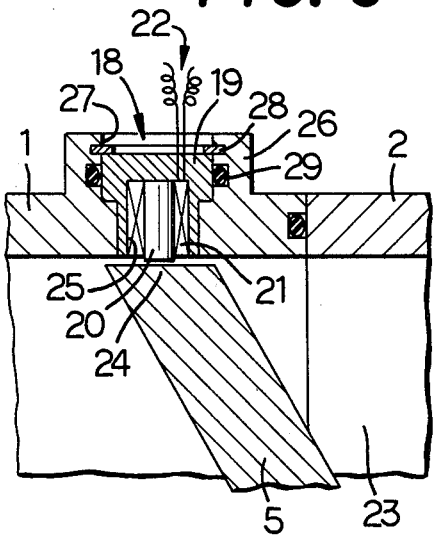
FIG. 3 is an axial sectional view of an essential part of the compressor in FIG. 1 taken in a different phase from that in FIG. 2.

Describing in detail the rotation sensor of this invention with reference to FIG. 3, which is an enlarged section of an essential part of the sensor taken at a different phase from the section in FIG. 2, a swash-plate 5 rotating in a swash-plate chamber 23 is made of a magnetic material, for example a ferrous material which includes cast iron, steel and other iron-containing magnetic material. And a part of the peripheral portion of the swash-plate of elliptical shape located on the major axis, which coincides with the slanting direction of the swash-plate, and in the vicinity constitutes a sensed portion 24. In the wall portion of the cylinder block 1 an electromagnetic sensor 18 is installed such that it can be faced or opposed to a part of the rotational locus of the sensed portion 24. The electromagnetic sensor 18 is composed of a sensor body 19 made of aluminum or synthetic resins, a permanent magnet 20 and a coil 21 wound about the permanent magnet 20, wherein the sensor body 19 is provided with, on one end surface thereof, a blind hole 25 in which the permanent magnet 20 and the coil 21 are accommodated. The sensor body 19 has a large external diameter at a farther portion thereof away from the end surface having the blind hole 25 than at a nearer portion. The sensor body 19 is fitted from outside into a stepped hole 27 formed through an outwardly projected portion 26 of the cylinder block 1, and it is prevented from coming off by a snap ring 28 of C form fixed on the inside surface of the stepped hole 27. The fluid tightness between the sensor body 19 and the cylinder block 1 is maintained by a seal ring 29 fitted in a circumferential groove formed on the inside surface of the stepped hole 27. The coil 21 is with a lead wire 22 connected to a control circuit including an amplifier 105 and a pulse monitoring circuit 106 shown in FIG. 1.

Figure 4:
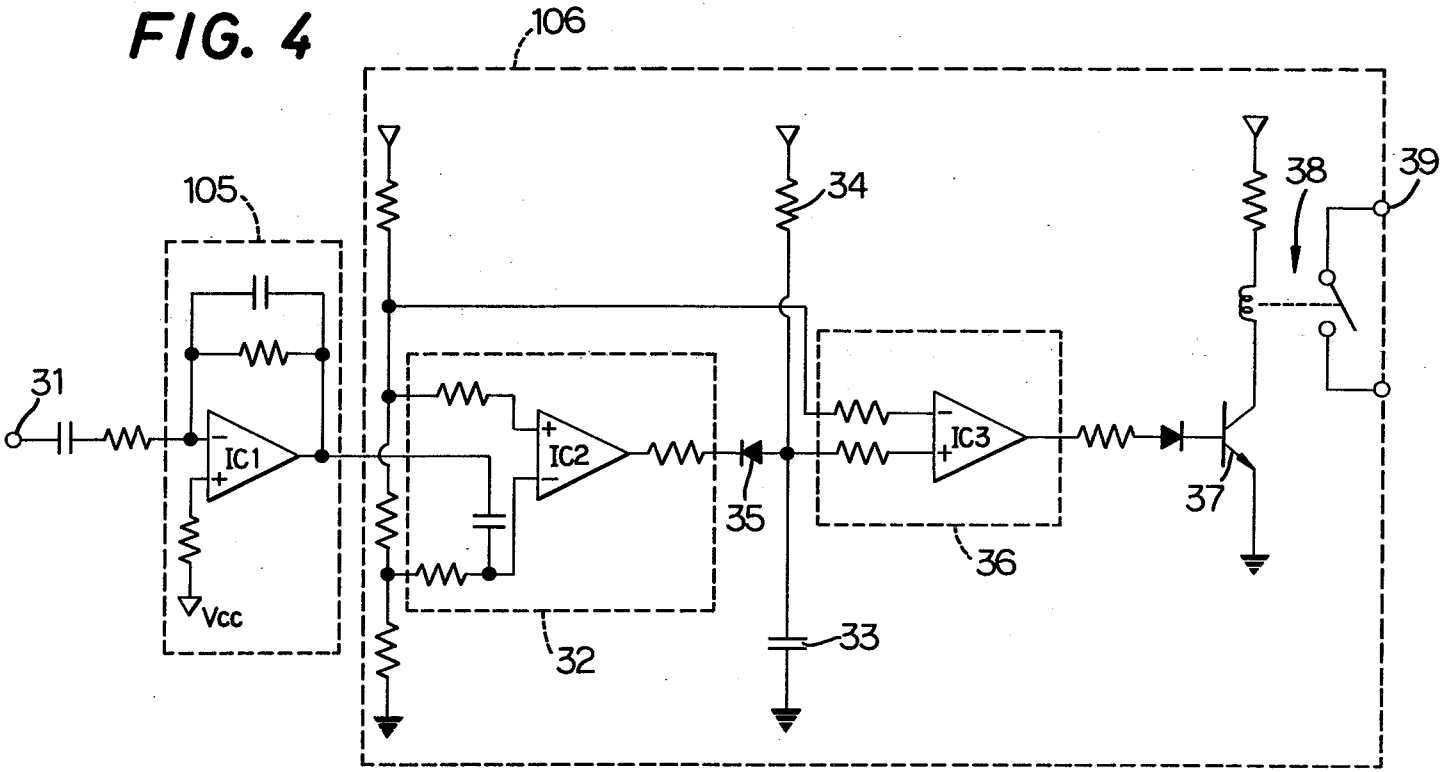
FIG. 4 is an electric circuit diagram related to the amplifier and the pulse monitoring circuit shown in FIG. 1.

With reference to FIG. 4 illustrating the amplifier 105 and the pulse monitoring circuit 106 operation of the above-mentioned apparatus will be described hereunder.

Figure 5:
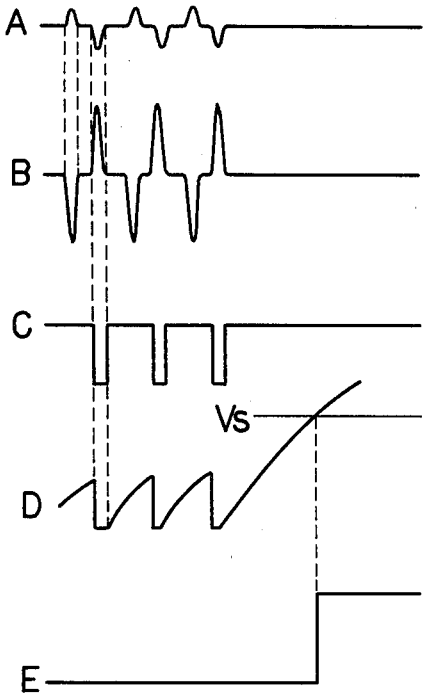
FIG. 5 is a graph showing the wave forms of signals in individual part of the electric circuit in FIG. 4.

When the rotary shaft 3, which is connected to the engine 104 via the electromagnetic clutch 102, is rotated the swash-plate 5 secured thereto will naturally be rotated as to reciprocate the piston 8 in the cylinder bore 4, with a result of compressing a gaseous refrigerant. At this time the rotation of the rotary shaft 3 moves or rotates the sensed portion 24 along a circular locus. As the density of the magnetic flux formed around the permanent magnet 20 is changed every time the sensed portion 24 is faced to the permanent magnet 20, electric current is generated in the coil 21 at each change of the magnetic flux density. Consequently pulses are generated from the coil 21 at a period or interval in response to the rotational speed of the swash-plate 5 and the rotary shaft 3. While the compressor is in normal working the pulses shown in FIG. 5 by A are, therefore, periodically generated and supplied to an input terminal 31 shown in FIG. 4. This signal will be amplified by the amplifier 105 to be the signal shown in FIG. 5 by B. The signal thus amplified will be made into a signal of rectangular wave form, as shown in FIG. 5 by C, by a comparator 32 for being provided to a capacitor 33. The capacitor 33 is charged, while the voltage of the comparator 32 is at the output terminal thereof in high level, via a resistor 34; when the voltage has become low in level the capacitor 33 begins to be discharged via a diode 35. The voltage of the capacitor 33 is varied as shown in FIG. 5 by D. The voltage of the capacitor 33 is provided to the non-inverting input terminal of a comparator 36 for being compared with the standard voltage Vs provided to the inverting input terminal.

When the compressor is accidentally stopped of its working due to seizure of the sliding place (places) or damage of some parts, the pulses will not come out from the coil 21 of course. So sensing by the pulse monitoring circuit 106 of non-generation of the pulses, for a time duration beyond a predetermined length or interval, will cause provision of a clutch release commanding signal therefrom. In other words, ceasing of generation of pulses from the coil 21 will keep the voltage of the output terminal of the comparator 32 at high level, preventing the discharge of the capacitor 33. It results in making the voltage provided to the non-inverting input terminal of the comparator 36 higher than the standard voltage Vs, as shown in FIG. 5 by D, which changes the output signal from the comparator 36 to high level. A transistor 37 will consequently be turned ON to operate a relay 38. The release commanding signal shown in FIG. 5 by E will be provided from an output terminal 39 to the clutch 102, which causes the compressor 101 to be separated from the engine 104. It will effectively protect the driving apparatus including the engine 104, the belt transmission mechanism 103, etc., and other instruments and appliances. Practically speaking, however, extremely slowed rotational speed of the rotary shaft 3 makes the pulses insufficiently low in the level thereof for being sensed, so the above described action takes place immediately before the compressor completely stops.

In this embodiment motion amount or distance of the sensed portion 24 when it approaches to and departs from the electromagnetic sensor 18 and motion speed thereof are both relatively large, so the variation of the magnetic flux density appears clearly and largely, which permits the signal pulses to be large in size and less susceptible to noise and consequently permits the above-mentioned regulation to be accurate. And parts and members which influence the precision of the relative position between the swash-plate 5 and the electromagnetic sensor 18 are limited to the rotary shaft 3, the radial bearings 17 and the cylinder blocks 1, 2. All of those are easy to be finished with high precision. Therefore the dispersion observed in relation to the gap or clearance between the swash-plate 5 and the electromagnetic sensor 18 is very small, which allows the gap to be determined extremely small. The signal pulses obtained by the electromagnetic sensor 18 are naturally expected to be large.

Figure 6:
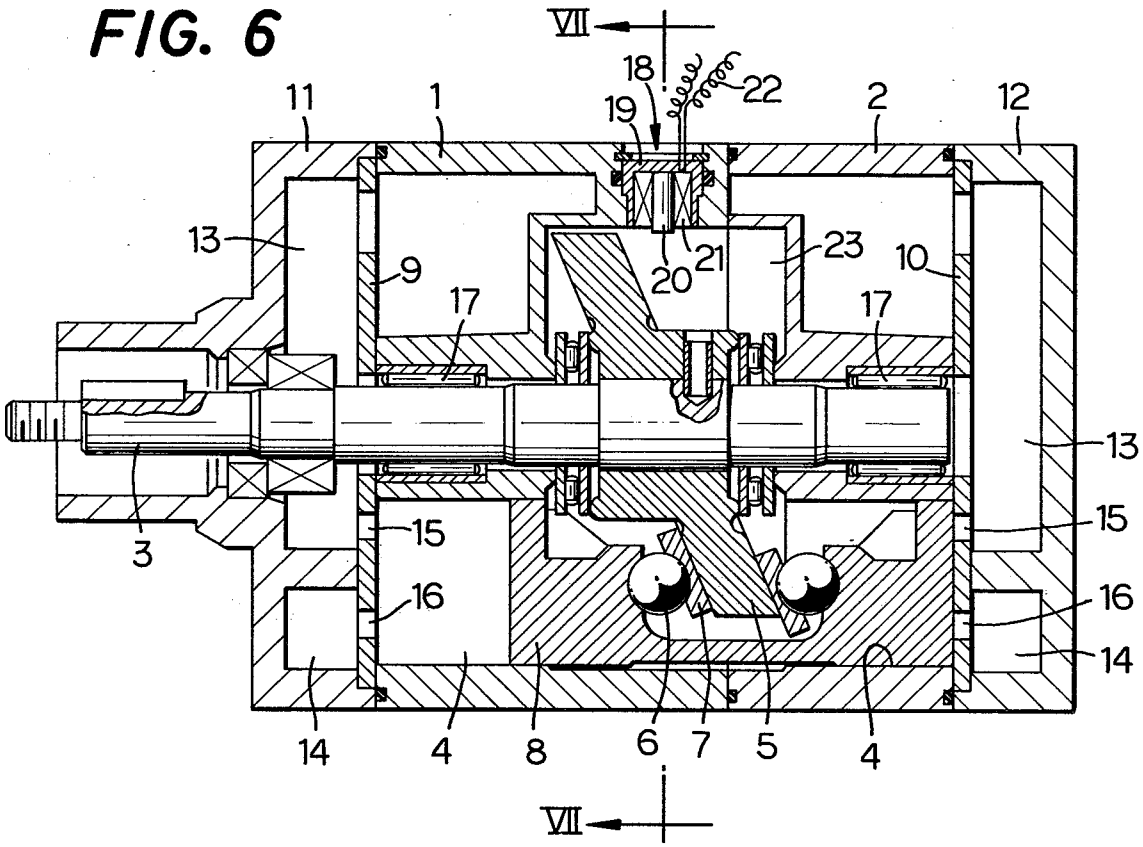
FIG. 6 is an axial sectional view of a compressor including another embodiment of the rotation sensor.
Figure 7:
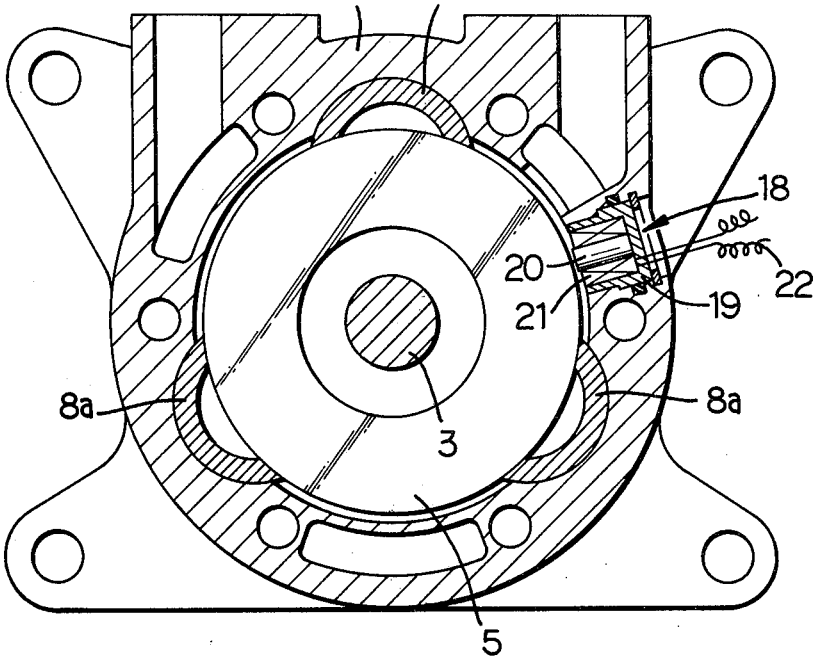
FIG. 7 is a cross sectional view taken along the line VII—VII of the compressor in FIG. 6.

Another embodiment will be described with reference to FIGS. 6 and 7.

Figure 8:
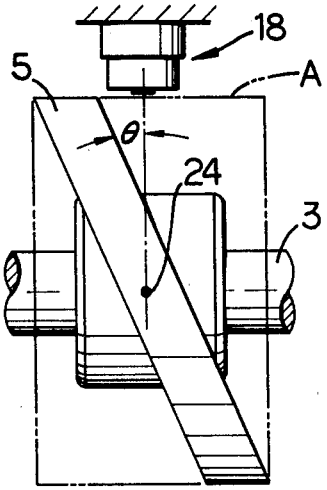
FIG. 8 is an explanatory view for showing the mounted position of the electromagnetic sensor in relation to the swash-plate.

In this embodiment a pair of parts are selected as the sensed portions 24 in the peripheral portion of the swash-plate 5 of cast iron. The two places are symmetrically located on either polarly parted portion with the phase difference of 180° on the short diameter of the swash-plate 5 of elliptical shape, which is differently phase by 90° to the slant direction of the swash-plate 5, for describing the same rotational locus to each other. The electromagnetic sensor 18 is therefore secured on the cylinder block 1 as shown in FIG. 8 such that it can be faced to the center in the axial direction of a cylindrical locus A described by the whole peripheral portion of the swash-plate 5. Except this point all of the description to the previous embodiment holds true to this embodiment. So the same parts are alloted the same numerals and signs, omitting superfluous explanation.

As the two sensed portions 24 with the phase difference of 180° pass near the electromagnetic sensor 18 in one rotation of the swash-plate 5, the number of pulse generation is doubled over that in the previous embodiment. And the belt-like peripheral surface of the swash-plate 5 is slanted at the largest angle $\theta$ in the vicinity of the sensed portions 24 in relation to the rotational direction of the swash-plate 5, so the variation of the magnetic flux density generated in the electromagnetic sensor 18 appears most acutely or sharply, which means that the signal pulses produced there are very clean being rarely influenced by noise. The rotation of the rotary shaft 3 can be sensed in this embodiment at a higher sensitivity than in the previous embodiment. Shortening of the interval time of the pulse generation in this embodiment enables the set time of the pulse monitoring circuit 106 to be shortened that much, leading to the shortening of the time required from the trouble happening in the compressor to the release of the electromagnetic clutch. It is meritorious in improving the protection of the driving apparatus, etc.

Although the end surface of the permanent magnet 20 in the electromagnetic sensor 18 is directly opposed to the external periphery of the swash-plate 5 in this embodiment, the former may be provided with a cover on the end surface thereof opposed to the latter.

Figure 9:
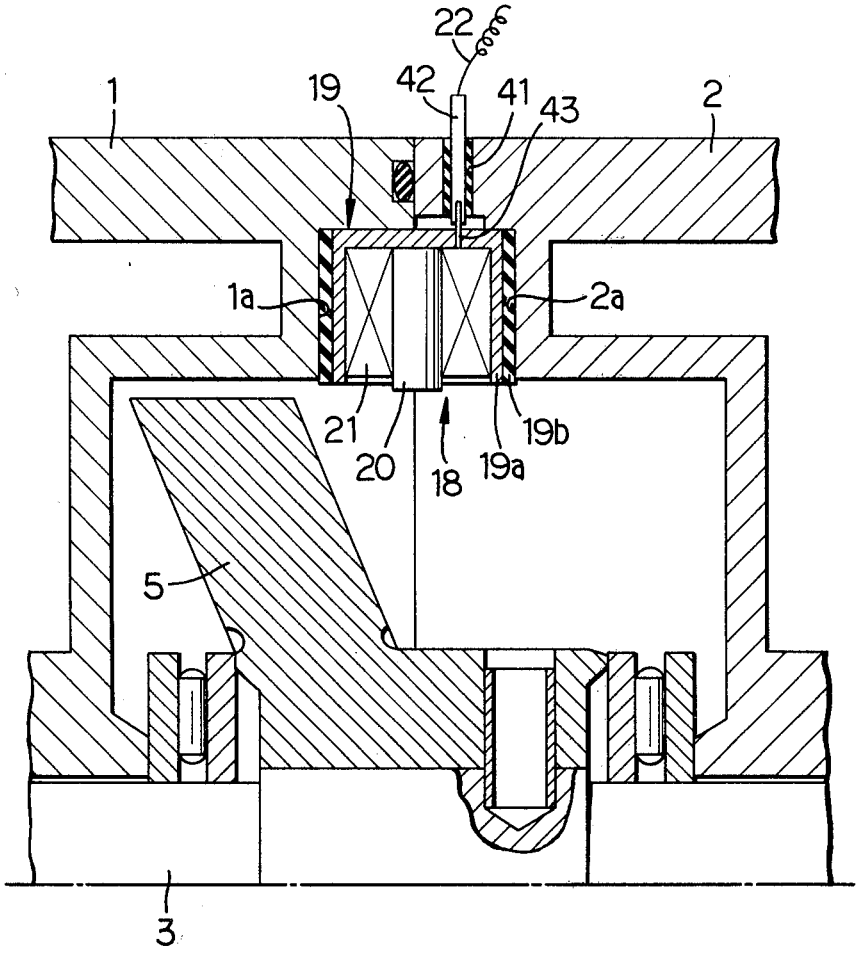
FIG. 9 is an axial sectional view of still another embodiment of the rotation sensor.

Still another embodiment will be described further with reference to FIG. 9, wherein the electromagnetic sensor 18 is fixed to the joined portion of the cylinder blocks 1, 2 of a half splittable type. In each of the cylinder block 1, 2 splitted into two in the middle a semi-cylindrical recess 1*a*, 2*a* is formed on the joint portion to be faced to each other, and the sensor body 19 of the electromagnetic sensor 18 is composed of a case 19*a* and an elastic body 19*b* of rubber or resin fitted on the cylindrical surface of the case 19*a* (the case 19*a* itself may be made into an elastic body). The elastic body 19*b* is made into a cylindrical body slightly larger in the external diameter thereof than the internal diameter of the cylindrical recess formed by the semi-cylindrical recesses 1*a*, 2*a*. On the coil 21 a connector 43 connectable to a connector 42, which is fixed with synthetic resin 41 to the rear side cylinder block 2 and connected to the lead wire 22, is provided.

In this embodiment of the above-mentioned structure the electromagnetic sensor 18 is fitted into the recess 2*a* of the rear side cylinder block 2 and the connector 43 is inserted into the connector 42, before the two cylinder blocks 1, 2 are joined, for being temporarily held there, and the sensor 18 can be firmly accommodated in the recess when the front side cylinder block 1 is firmly joined. The elastic body 19*b* enveloping the case 19*a* can be elastically held or sandwiched by both cylinder blocks 1, 2, with a desirable effect of stable holding resistive to vibration of the electromagnetic sensor 18. This embodiment employing a half splitting type cylinder block is easy in assemblying and manufacturing compared to a cylinder block of a type unevenly splitted; another merit resides in that the joining of the two cylinder blocks with an elastic body 19*b* sandwiched inbetween allows the error tolerance in the machining of the recesses 1*a*, 2*a* to be comparatively less severe, which is a kind of merit in the manufacturing process.

Figure 10:
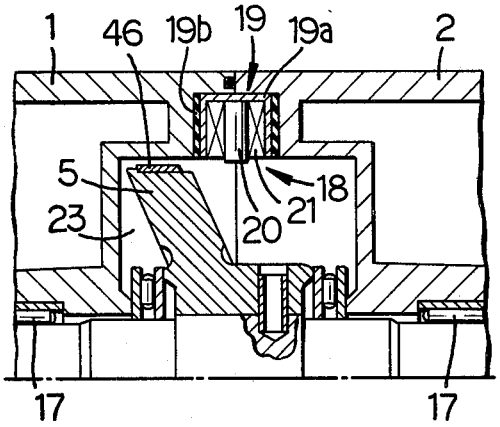
FIG. 10 is an axial sectional view of still another embodiment of the rotation sensor.

Still another embodiment shown in FIG. 10 will be described next, wherein the swash-plate 5 is made of an aluminum alloy, a kind of non-magnetic material, and provided with a steel made ring 46 fitted on the periphery thereof as a magnetic body for constituting the sensed portion. On the side of the cylinder blocks 1, 2 the electromagnetic sensor 18 is disposed at the joined portion of both cylinder blocks 1, 2 so that it may be opposed to the axial central portion of the locus of cylindrical form described by the ring 46. The electromagnetic sensor 18 can therefore be faced to the ring 46 twice per one rotation of the swash-plate 5, generating a pulse signal whenever it is faced to the ring 46. This embodiment is featured in being capable of sensing the rotation in a compressor of small mass employing a light swash-plate of aluminum alloy. This structure of the swash-plate 5 of an aluminum alloy having the ring 46 on the periphery also makes the slidability with the piston connecting portion which is again made of an aluminum alloy much better, preventing wear and seizure of the sliding places. The piston connecting portion is designated by numeral 8*a* in FIG. 7.

Still other embodiments will be described with reference to FIGS. 11–15.

Figure 11:
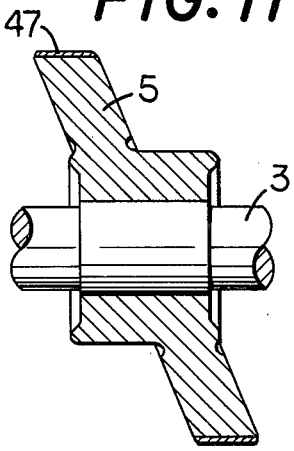
FIG. 11 is an axial sectional view of a swash-plate related to still another embodiment of the rotation sensor.

FIG. 11 illustrates an embodiment in which the swash-plate 5 of an aluminum alloy is provided with a sprayed layer 47 of ferrous material all over the peripheral surface thereof as a magnetic body constituting the sensed portion. The sprayed layer 47 means the ferrous material which has been melted and sprayed by compressed air or a gas onto the peripheral surface of the swash-plate 5 of aluminum before being solidified. The merit of this embodiment is almost similar to that of the embodiment having the ring 46.

Figure 12:
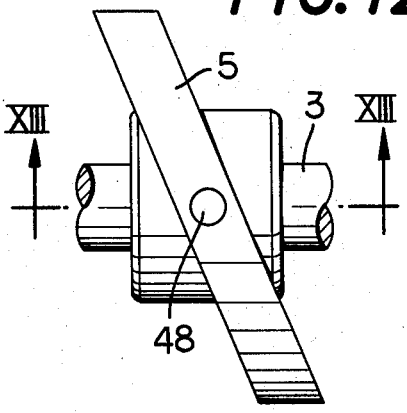
FIG. 12 is an elevational view of the swash-plate related to the rotation sensor in accordance with this invention.
Figure 13:
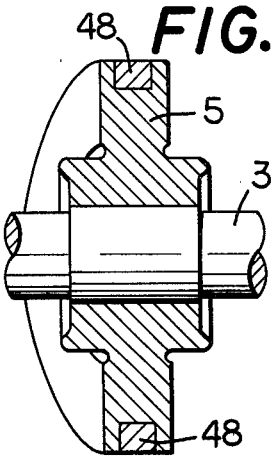
FIG. 13 is an axial sectional view taken along the line XIII—XIII of FIG. 12.

An embodiment shown in FIGS. 12 and 13 has a magnetic body 48 imbedded at least one place on the periphery of the swash-plate 5 made of an aluminum alloy. As the magnetic body 48 for this case a ferrous material, a temperature sensitive ferrite, or a magnet may be good for the purpose. In this embodiment the number of pulses is coincided with that of the magnetic bodies 48 imbedded. It is a matter of course that the magnetic bodies 48 must be imbedded on the same movement locus, and that the motion speed of them is equal to the rotational speed of the periphery of the swash-plate 5. When, in particular, the magnetic body 48 is made of a temperature sensitive ferrite, it will lose its magnetism in the event that the temperature of the swash-plate 5 has abnormally been raised due to shortage of refrigerant gas in the circuit so as to exceed the Curie point of the temperature sensitive ferrite. In this situation the electromagnetic sensor 18 will not generate pulse signals any longer irrespective of the continuous rotation of the swash-plate 5, and the pulse monitoring circuit 106 make the same judgement as in the case of abnormal or emergency stop of the compressor to release the electromagnetic clutch before the swash-plate 5, the ball 6, the shoe 7, etc., are seizured. It will contribute to the protection of the compressor. Incidentally it is desirable to employ a temperature sensitive ferrite having the Curie point of about 200° C. In the event the magnetic body 48 is a magnet, both sides of the sensor and the sensed portion are magnets, to be greatly advantageous. The variation of the magnetic flux density becomes more clear and sharp, producing pulses of high voltage less influenced by noise.

Figure 14:
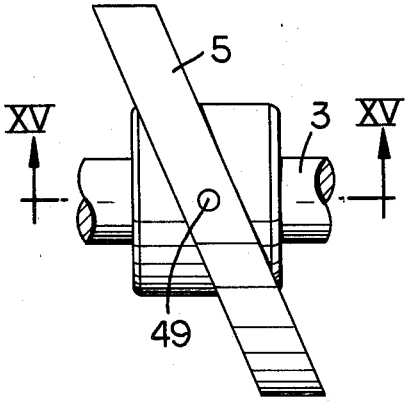
FIG. 14 is an elevational view of the swash-plate related to the rotation sensor in accordance with this invention.
Figure 15:
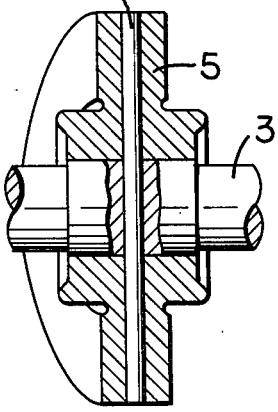
FIG. 15 is an axial sectional view taken along the line XV—XV of FIG. 14.

An embodiment shown in FIGS. 14 and 15 utilizes a pin 49 of ferrous material for preventing the slide-rotation of the swash-plate 5 of aluminum secured on the rotary shaft 3 as a magnetic body. The pin 49 is pierced through the swash-plate 5 of elliptical form along the minor axis thereof so as to be exposed outside the periphery of the swash-plate at either end of the pin 49. The electromagnetic sensor 18 generates pulse signals whenever it is periodically faced to the exposed end of the pin 49. It is meritorious in this embodiment that the pin, being an essentially required member, is utilized as the magnetic body. It eliminates of course employment or introduction of a surplus member.

Figure 16:
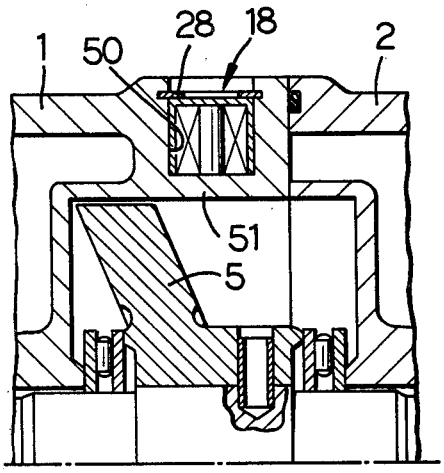
FIG. 16 is an axial sectional view of still another embodiment of the rotation sensor in accordance with this invention.

FIG. 16 shows still another embodiment, wherein the cylinder blocks 1, 2 are made of aluminum, a non-magnetic material and the electromagnetic sensor 18 is attached on the external side of the cylinder block. In a blind hole 50 formed on the external side of the cylinder block 1 the electromagnetic sensor 18 is fitted, being prevented of coming off with a snap ring 28. The electromagnetic sensor 18 is therefore opposed, with a wall 51 of the cylinder block 1 inbetween, to the periphery of the swash-plate 5 of cast iron. Because of the non-magnetic material of the cylinder block 1 and the largeness of the ratio between the nearest distance and the farthest distance of the periphery of the swash-plate 5 as the sensed portion, while in rotation, to and from the electromagnetic sensor 18 permits the sensor 18 to generate sharp pulses being influenced relatively less by noise or the like. When a permanent magnet is imbedded as the sensed portion in the periphery of the swash-plate 5 in such an embodiment the pulses becomes more distinct. As other merits of this type embodiment where the electromagnetic sensor 18 is attached on the outside of the housing, that is the cylinder block 1, of the compressor (1) easiness of mounting the electromagnetic sensor 18, (2) no need of keeping air tightness between the sensor 18 and the housing, (3) no fear of gas leakage, and (4) easiness of replacing the sensor 18 in case of damage or trouble can be enumerated.

What is claimed is:

1. A rotation sensor for a swash-plate type compressor which includes a housing with at least one cylinder bore, a rotary shaft rotatably retained by said housing, a swash-plate secured thereto in a slant posture, and at least one piston engaged with said swash-plate for being reciprocated in said cylinder bore according to the rotation of said swash-plate, said rotation sensor comprising:

a part of the peripheral portion of said swash-plate as a portion-to-be-sensed; and an electromagnetic sensor disposed at a position opposed to a part of a movement locus described by said portion-to-be-sensed according to the rotation of said swash-plate for generating an electric signal respondent to variation of magnetic flux density caused by every passing of said portion-to-be-sensed close thereto, said electromagnetic sensor including a permanent magnet and a coil disposed in the vicinity thereof.

2. A rotation sensor in accordance with claim 1, wherein said swash-plate is wholly made of a magnetic material and a pair of parts on the peripheral portion of the swash-plate positioned away from each other with a phase difference of approximately 180° and describing a same rotational locus are utilized as said portion-to-be-sensed.

3. A rotation sensor in accordance with claim 1, wherein said swash-plate is made of a non-magnetic material and a magnetic body secured to the peripheral portion of said swash-plate constitutes said portion-to-be sensed.

4. A rotation sensor in accordance with claim 3, wherein said magnetic body is secured at at least two places of the peripheral portion of said swash-plate which are positioned away from each other with a phase difference of approximately 180° and describe the same rotational locus.

5. A rotation sensor in accordance with claim 3, wherein said magnetic body is a ring of ferrous material fitted on the periphery of said swash-plate.

6. A rotation sensor in accordance with claim 3, wherein said magnetic body is a ferrous layer sprayed on the periphery of the swash-plate.

7. A rotation sensor in accordance with claim 3, wherein said magnetic body is a lump made of ferrous material, being imbedded in at least one place on the periphery of said swash-plate.

8. A rotation sensor in accordance with claim 3, wherein said magnetic body is a lump made of a temperature sensitive ferrite, being imbedded in at least on place on the periphery of said swash-plate.

9. A rotation sensor in accordance with claim 3, wherein said magnetic body is a pin of ferrous material for securing said swash-plate to said rotary shaft.

10. A rotation sensor in accordance with claim 3, wherein said magnetic body is a permanent magnet imbedded in at least one place on the periphery of said swash-plate.

11. A rotation sensor in accordance with claim 3, wherein said swash-plate is made of an aluminum alloy.

12. A rotation sensor in accordance with claim 1, wherein said housing is made of a non-magnetic material and said electromagnetic sensor is secured on the outside of said housing for being opposed to, with a wall of said housing inbetween, said portion-to-be-sensed.

13. A rotation sensor in accordance with claim 1, wherein said electromagnetic sensor is composed of a sensor body of non-magnetic material, a permanent magnet accommodated in said sensor body, and a coil wound about said permanent magnet.

14. A rotation sensor in accordance with claim 1, wherein said housing includes a pair of cylinder blocks joined face to face to each other on a plane perpendicular to the axis of said rotary shaft, and said electromagnetic sensor is fixedly placed in a pair of recesses which are respectively formed at a joined surface of each of said pair of cylinder blocks in a sandwiched state between said pair of cylinder blocks.

* * * * *